United States Patent [19]

Schaapveld

[11] Patent Number: 4,890,366

[45] Date of Patent: Jan. 2, 1990

[54] CULTURED MARBLE CASKET AND METHOD OF PRODUCING SAME

[76] Inventor: Kenneth L. Schaapveld, 1605 Brown Oaks Dr., Oklahoma City, Okla. 73127

[21] Appl. No.: 260,884

[22] Filed: Oct. 21, 1988

[51] Int. Cl.[4] ..... A61G 17/00

[52] U.S. Cl. ..... 27/7; 27/2; 264/135

[58] Field of Search ..... 272/7, 1–6, 272/35, 10, 11; 264/45, 135, 256; 156/83, 110

[56] References Cited

U.S. PATENT DOCUMENTS

| | | | |
|---|---|---|---|
| 2,848,780 | 8/1958 | Gosnell | 27/7 |
| 2,940,156 | 6/1960 | Cook | 27/7 X |
| 3,159,901 | 12/1964 | Harrington et al. | 27/7 |
| 3,545,055 | 12/1970 | Pane | 27/7 |
| 4,253,220 | 3/1981 | Work | 27/7 X |

FOREIGN PATENT DOCUMENTS

| | | | |
|---|---|---|---|
| 2602419 | 2/1988 | France | 27/7 |

*Primary Examiner*—Richard E. Chilcot, Jr.
*Attorney, Agent, or Firm*—Bill D. McCarthy

[57] ABSTRACT

A light weight cultured marble casket is provided which is aesthetically pleasing in appearance, durable in construction and resistant to deterioration by the elements. The casket comprises a body member having an exterior portion formed of cultured marble and a base member (which cooperates with the body member to form a unitary structure having a cavity formed therein), a closure assembly pivotally connected to the body member for selectively sealing the cavity and for permitting access thereto, and a securing assembly for securing and locking the closure assembly to the body member when the closure assembly is in a closed sealing position. The base or bottom portion of the casket, as well as the interior portion of the body member and the interior portion of the closure assembly, are fabricated of a fiberglass-containing resinous material. The cultured marble composition comprises from about 40 to about 60 parts by weight of a polyester casting resin, from about 80 to about 120 parts by weight of a particulate material, a catalytic amount of a catalyst capable of cross-linking the polyester casting resin, and an effective minor amount of a pigment capable of providing the cured cultured marble composition with the color and texture desired. A method for the fabrication of such cultured marble caskets is also set forth.

44 Claims, 3 Drawing Sheets

CULTURED MARBLE CASKET AND METHOD OF PRODUCING SAME

BACKGROUND OF THE INVENTION

1. Field of the Invention

The present invention relates generally to caskets, and more particularly but not by way of limitation, to a cultured marble casket and method for producing same.

2. Brief Description of the Prior Art

Caskets have long been known and used in burial of deceased persons. Generally, such caskets are fabricated of stamped metal, crafted wood, or fiberglass. In the fabrication of the stamped metal caskets the metal dyes employed are heavy, and require bulky machinery. Thus, the cost of fabrication of stamped metal caskets is often excessively expensive. Further, caskets fabricated of stamped metal are subject to rust and subsequent deterioration.

Crafted wood caskets are fabricated of glued hardwoods and their fabrication requires specialized wood-shaping equipment and highly skilled craftsmen, thus making the fabrication of such caskets labor intensive. Wood caskets are also subject to deterioration because of moisture absorption and deterioration of the adhesive employed in the fabrication of such caskets.

Caskets fabricated of fiberglass overcome some of the before-mentioned problems of the stamped metal and crafted wood caskets. Fiberglass caskets are commonly fabricated using a sandable polyester resin so that the casket can be painted to the desired color. Problems, however, often arise in the fabrication of fiberglass caskets because air voids frequently occur between the polyester resin and fiberglass reinforcement. Such air voids result in a casket of inferior quality and require post-production repairs of the product prior to painting.

Caskets fabricated of stamped metal, crafted wood and fiberglass each require that the casket be sanded, primed and post-painted after the casket has been fabricated. Because of the chemical dissimilarity of the materials used to fabricate and post-finish caskets of stamped metal, crafted wood and fiberglass, problems have heretofore been encountered in chemically bonding a substrate to the exterior surface of such caskets which could alter the aesthetic appearance of the casket.

Because of the aforementioned problems in the fabrication and deterioration of the prior art caskets, the need has remained for improving caskets, as well as improved methods for producing caskets which overcome the inherent defects encountered by the selection of the materials employed in the fabrication of the caskets. It would be highly desirable if a light weight casket could be fabricated of cultured marble which would be economical to produce without sacrificing the desired aesthetic qualities that such a casket would possess. Further, such a casket would be substantially resistant to deterioration. It is to such a casket and method for producing same that the present invention is directed.

SUMMARY OF THE INVENTION

According to the present invention, a light weight cultured marble casket is provided which is aesthetically pleasing in appearance, durable in construction and resistant to deterioration by the elements. Broadly, the casket comprises a body member having an exterior portion formed of cultured marble and a base member (which cooperates with the body member to form a unitary structure having a cavity formed therein), a closure assembly pivotally connected to the body member for selectively sealing the cavity and for permitting access thereto, and a securing assembly for securing and locking the closure assembly to the body member when the closure assembly is in a closed sealing position. The base or bottom portion of the casket, as well as the interior portion of the body member and the interior portion of the closure assembly, are fabricated of a fiberglass-containing resinous material which can readily bond to the cultured marble.

The cultured marble composition employed in the fabrication of the exterior of the body member and the exterior of the closure assembly is a mixture of selected constituents which can be cured at ambient temperatures. Such a cultured marble composition comprises from about 40 to about 60 parts by weight of a polyester casting resin, from about 80 to about 120 parts by weight of a particulate material, a catalytic amount of a catalyst capable of cross-linking the polyester casting resin, and an effective minor amount of a pigment capable of providing the cured cultured marble composition with the color and texture desired.

In the fabrication of the cultured marble casket a body mold is employed which comprises a first portion and a second portion. The first and second portions are matingly aligned and secured together by a mold frame so that a passageway is formed therethrough. The walls of the mold, which define the passageway, function as the mold surfaces for the formation of the body member of the casket. In fabricating the casket of the present invention an effective amount of a viscous polyester resin is applied to an interior surface (i.e. the mold surfaces) of the body mold so as to provide the body mold with a resilient, flexible surface. The polyester resin, which is curable at ambient temperatures, consists essentially of styrene monomer. The cultured marble composition is then applied to the resin-coated surface of the body mold and allowed to cure.

When the cultured marble has cured, a mold for a base member is positioned adjacent a lower portion of the passageway defined by the body mold. Fiberglass is then applied to the mold of the base member so that the fiber glass adheres to the body member of the casket. This results in the formation of a unitary member consisting of the base member and the body member.

The cover assembly for the body member is likewise formed by applying the cultured marble composition to a resin-coated surface of a cover mold and permitting the composition to cure. Thereafter, the body member and closure member assembly are removed from their respective molds and the closure assembly is pivotally connected to the body member so that the closure assembly can be selectively pivoted between a first body opening position and a second body closing position. The casket is further provided with a sealing or lock assembly for securing the closure assembly to the body member when the closure assembly is in the second position.

An object of the present invention is to provide an improved light weight casket.

Another object of the present invention, while achieving the before-stated object, is to provide a casket which is durable in construction, economical to manufacture, and which does not suffer from the deterioration characteristics of caskets of the prior art fabricated from stamped metal, crafted wood and fiberglass.

Yet another object of the present invention, while achieving the before-stated objects, is to provide a casket having improved aesthetic characteristics.

Another object of the present invention, while achieving the before-stated objects, is to provide an improved method for fabricating a casket which does not require specialized equipment, highly skilled craftsmen, and which is not labor intensive.

Other objects, advantages and features of the present invention will become clear from the following detailed description when read in conjunction with the drawings and the appended claims.

DETAILED DESCRIPTION

Figure 1:
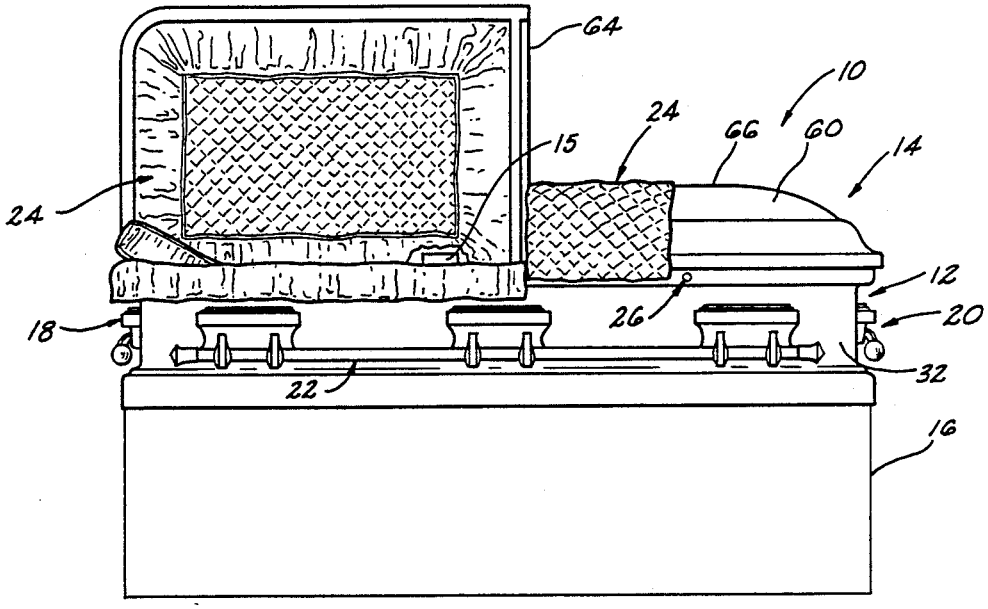
FIG. 1 is a side elevational view of a cultured marble casket constructed in accordance with the present invention wherein a portion of a closure assembly is pivotally moved to a position such that the casket is open for viewing.
Figure 2:
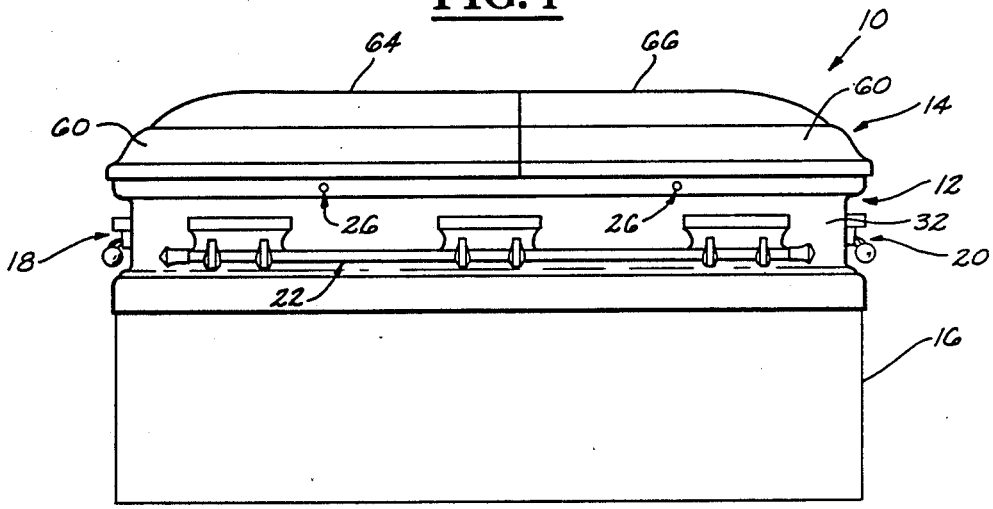
FIG. 2 is a side elevational view of the cultured marble casket wherein the closure assembly is in a closed position for sealing the casket.

Referring to the drawings, and more particularly to FIGS. 1 and 2, a cultured marble casket 10 of the present invention is illustrated. The casket 10 is provided with a body member or body portion 12 and a closure assembly 14 pivotally connected to the body member 12 via a plurality of hinges, such as hinge 15. Thus, the closure assembly 14 is pivotally movable between a first position (as shown in FIG. 1 wherein at least a portion of the closure assembly is in a casket body opening position) and a second position (as shown in FIG. 2 wherein the closure assembly is in a closed position for sealing the body portion of the casket).

The casket 10 is illustrated as being supported on a support platform 16 in a conventional manner. Handle assemblies 18 and 20 are secured to each end portion of the body member 12; and handle assemblies, such as handle assembly 22, are secured to each side portion of the body member 12 for permitting the casket 10 to be carried.

A decorative fabric material 24 is disposed adjacent an interior portion of the body member 12 and the closure assembly 14 to provide the interior of the casket 10 with a pleasing decorative effect. To seal the cover assembly 14 to the body member 12 (when same is in the closed position (as illustrated in FIG. 2) a plurality of securing or lock assemblies 26 are disposed about the body member 12 and the closure assembly 14. The lock assemblies 26 are constructed such that a male portion is positioned along the edge portions of the body member 12 or the closure assembly 14 and a female portion is positioned along an adjacently disposed edge of the body member 12 or the closure assembly 14 such that when the closure assembly is in the closed position the male and female portions of the lock assemblies 26 matingly engage. Thus, the lock assemblies 26 lock and secure the closure assembly 14 to the body member 12 when same is in the closed position.

The casket 10 further includes an adjustable bed member 28 (see FIG. 5) supported within an interior cavity 30 of the body member 12. The adjustable bed member 28 is covered with the decorative fabric material (not shown) in a customary manner.

The components of the casket heretofore described, with the exception of the fabrication of the body member 12 and the closure assembly 14 of cultured marble, are conventional components heretofore known and employed in the fabrication of caskets. Thus, no further comments or description of such conventional components (i.e. the handle assemblies 18, 20 and 22, the decorative fabric material 24, the lock assemblies 26 and the adjustable bed member 28) are believed necessary to enable one to fully understand and comprehend the interconnection of the various components and the use of same in the fabrication of the cultured marble casket 10.

Figure 4:
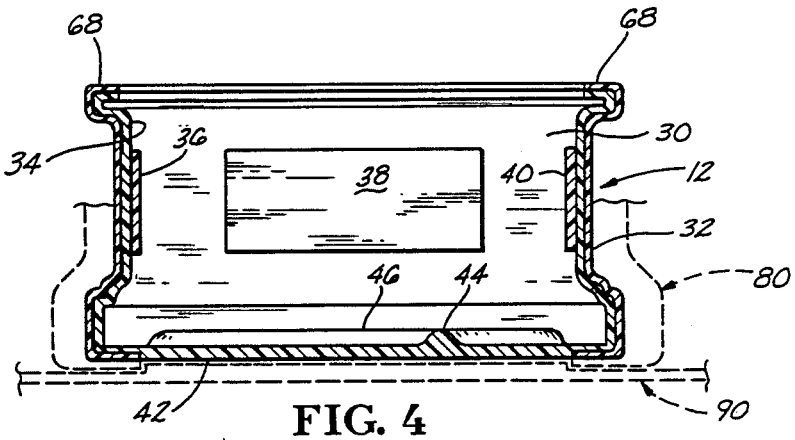
FIG. 4 is a cross-sectional view of the body portion of the casket and illustrating, in phantom, the relationship between the body mold and a floor mold employed in the fabrication of the body member and the floor or bottom portion thereof.
Figure 5:
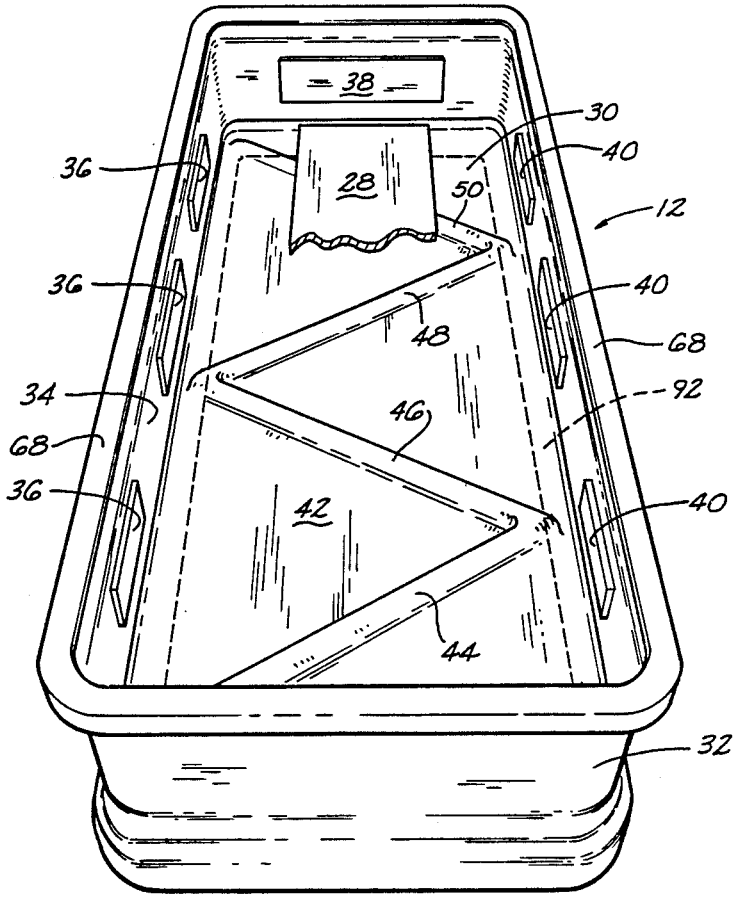
FIG. 5 is a perspective view of the body portion of the casket illustrating a cavity formed therein and a fragmental portion of an adjustable bed member disposed within the cavity.

Referring now to FIGS. 4 and 5, the body member 12 of the casket 10 is provided with a cultured marble exterior portion 32 and a fiberglass interior portion 34. Because the fiberglass and the cultured marble are formulated of base materials (i.e. resins) which are compatible and capable of being cross-linked by a common catalyst, the cultured marble composition and the fiberglass constituent can be chemically bound to each other. Thus, the body member 12 of the cultured marble casket 10 has a substantially unitary structure which is light weight and can readily be moved from one location to another, but which at the same time gives an aesthetic appearance of marble.

To reinforce the body member 12 of the cultured marble casket, the body member 12 further comprises a plurality of reinforcing members, such as members 36, 38 and 40, selectively positioned about the interior fiberglass portion 34 of the body member 12 so as to be disposed at the location where the handle assemblies (such as the handle assemblies 18, 20 and 22 illustrated in FIGS. 1 and 2) are secured to the body member 12. The reinforcing members can be fabricated of any suitable material having the desired structured strength and weight, such as wood, fiberglass matting, sheet material and the like.

To provide the desired weight characteristics to the cultured marble casket 10, a base or bottom 42 of the body member 12 is fabricated of a fiberglass-containing resinous material similar to that employed to form the interior fiberglass portion 34 of the body member 12. By utilizing the fiberglass-containing resinous material in the formation of the base 42 of the body member 12, the base 42 and the body member 12 constitute a substantially unitary member as shown in FIG. 5. That is, the fiber-glass-containing resinous material employed to form the base 42 chemically bonds to the interior fiberglass portion 34 of the body member 12 so that a unitary structure comprising the body member 12 and the base 42 is formed.

In order to reinforce the base member a plurality of tubular reinforcing members 44, 46, 48 and 50 are angularly disposed along the base 42 of the body portion 12. The tubular reinforcing members 44, 46, 48 and 50 are connected and secured to the base 42 with the fiberglass-containing resinous material. Thus, the tubular reinforcing members 44–50 provide the body portion 12 of the cultured marble casket 10 with strength factors sufficient to support a body when same is placed on the adjustable bed member 28 within the body portion 12.

Figure 8:
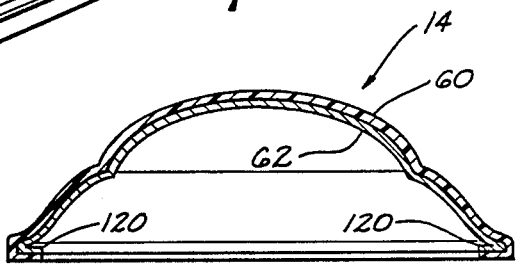
FIG. 8 is a cross-sectional view of the closure assembly of the casket.

Referring now to FIGS. 1, 2 and 8, the closure assembly 14 of the cultured marble casket 10 is provided with a cultured marble exterior portion 60 and a fiberglass interior portion 62. The fiberglass and the cultured marble are chemically bound so that the closure assembly (or each closure member thereof as the case may be) is a unitary structure which is durable, light weight, and has an aesthetic appearance of marble.

The closure assembly 14 will generally comprise two closure members or sections, such as closure members 64 and 66. When the closure assembly 14 comprises the closure members 64 and 66, the closure member 64 can be pivotally moved independently of the closure member 66. Further, the closure members 64 and 66 are each constructed such that the periphery of the closure members 64 and 66 provide a seal with an upper edge portion 68 of the body member 12 when the closure members 64, 66 are in the closed second position. To insure that an effective seal is formed between the body member 12 and the closure members 64, 66, a gasket (not shown) is positioned therebetween in a customary manner.

The lock assemblies 26 employed to seal the casket 10 (that is, to secure the closure members 64, 66 to the body member 12 when same are in the closed second position) comprise a male portion and a female portion. The male portions of the lock assemblies 26 are secured to the perimeter of the cover assembly 14 and the female portions of the lock assemblies 26 are disposed along the upper edge portion 68 of the body member 12. Thus, when the closure assembly 14 is in the closed second position, the male and female portions of the lock assemblies 26 matingly engage and secure the closure assembly 14 to the body member 12. The decorative fabric material 24 is secured within the interior portion of the closure members 64, 66 so as to provide the closure assembly 14 with an aesthetically pleasing appearance when one or both of the closure members 64, 66 are disposed in the first or open position.

The cultured marble composition employed in the fabrication of the exterior portions of the body member 12 and the closure members 64, 66 comprises a polyester casting resin, a particulate material (i.e. filler), a catalyst capable of cross-linking the polyester casting resin and an effective minor amount of a pigment capable of providing the cultured marble composition with the desired color and appearance. The effective amount of pigment employed in the cultured marble composition can vary widely depending on the degree of veining one desires in the cured cultured marble composition, which renders the composition with the desired aesthetic qualities.

The particulate material employed in the formulation of the cultured marble composition can be any suitable material compatible with the polyester casting resin; and the choice of such particulate material will be dependent, to a large degree, on the desired base or dominant color of the cured cultured marble. Illustrative of such particulate materials are marble dust, silica sand, aluminum trihydrate, frit (i.e. glass beads) and mixtures thereof. Marble dust is a commercially available product consisting of at least 98% calcium carbonate and is marketed by Basin Engineering of Wheatland, Wy.

Any suitable polyester casting resin compatible with the particulate material and pigment, and which can be catalytically cured at ambient temperatures, can be employed as the resin constituent of the cultured marble composition. Such resin compositions are commercially available and are well known in the cultured marble art. A typical polyester casting resin useful in the formulation of the cultured marble composition employed in the fabrication of the cultured marble casket is an unsaturated polyester casting resin manufactured by Silmar, a division of Sohio, Hawthorne, Calif.

The amount of catalyst required to cross-link the polyester casting resin can vary widely and will depend to a large degree upon the particular polyester casting resin employed in the formulation of the cultured marble composition. Such catalysts are commercially available compositions well known in the polyester casting resin art and are generally recommended by the resin manufacturer. For example, when the resin is an unsaturated polyester casting resin (as described above) a recommended catalyst for the resin is methylethyl ketone peroxide.

The amount of each constituent employed in formulating the cultured marble composition can vary widely. However, desirable results have been obtained wherein the cultured marble composition comprises from about 40 to about 60 parts by weight of the polyester casting resin and from about 80 to about 120 parts by weight of the particulate material. The catalytic amount of the catalyst employed in the formulation to effectively cross-link the resin can also vary widely but will generally be from about 0.06 to about 0.2 parts by weight, based on the total weight of the composition. Similarly, the effective minor amount of the pigment employed to provide the desired veining within the marble composition can vary widely but will generally be from about 0.03 to about 0.13 parts by weight, based on the total weight of the composition.

The cultured marble casket 10 as described above overcomes many of the disadvantages of the prior art caskets in that the cultured marble casket 10 is durable in construction, economical to manufacture, and does not suffer from deterioration characteristics of the prior art caskets. Further, fabrication of the cultured marble casket does not require specialized equipment, highly skilled craftsmen, and is not labor intensive, while at the same time providing a casket with a marble-like aesthetic appearance.

Fabrication of Body Portion

In the fabrication of the cultured marble casket 10 a plurality of molds are employed to form the body portion 12 and the closure assembly 14 of the casket 10. Each mold is fabricated of a suitable material having a substantially non-porous, smooth, resilient flexible molding surface. Typically, such molds can be fabricated of polyester resinous materials containing a sufficient amount of fiberglass to impart the desired strength and durability to the molds.

Figure 3:
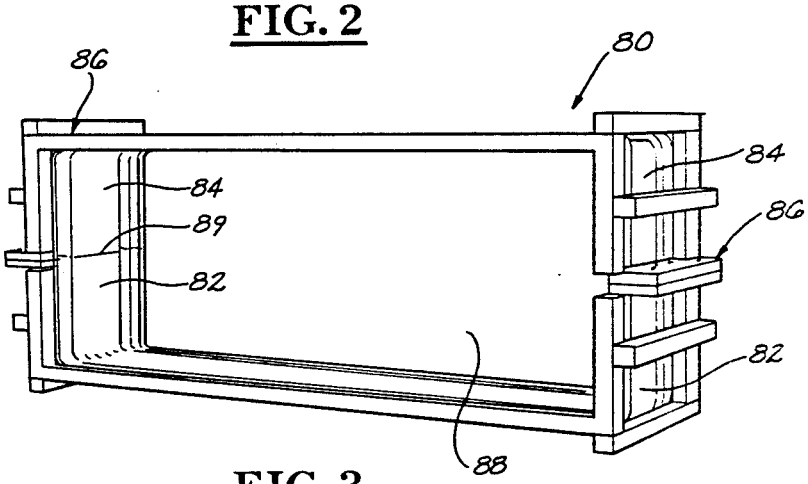
FIG. 3 is a perspective view of a mold employed in the fabrication of a body portion of the casket.

Referring now to FIGS. 3–5, the method and molds employed in the fabrication of the body portion 12 of the cultured marble casket 10 will be described. As shown in FIG. 3, a body mold 80 employed in the fabrication of the body portion 12 of the cultured marble casket 10 comprises a first portion 82 and a second portion 84. In an assembled position the first and second portions 82, 84, are matingly aligned and secured together by a mold frame 86 such that a passageway 88 is formed therethrough. As will be appreciated, the quality of the body portion 12 of the cultured marble casket 10 is largely determined by the condition of the mold surfaces of the body mold 80. That is, any imperfections in the mold surfaces of the body mold 80 will be repeated in the body portion 12 of the cultured marble casket 10 so it is very important that the body mold 80 be free of foreign matter, such as glass fibers, gel overspray, hair, dust and the like.

In preparing the body mold 80 for the fabrication of the body portion 12 all foreign matter is removed from the mold surfaces by applying a positive pressure to the mold surfaces from an air nozzle. After removal of such foreign matter the mold surfaces of the first and second portions 82 and 84 of the body mold 80 are waxed to insure good release of the finished body portion 12 from the body mold 80. The mold release wax is preferably applied with a soft sponge moved in a circular motion, taking care to overlap each adjacent area. Once the entire interior or mold surfaces of the first and second portions 82 and 84 of the body mold 80 have been thoroughly coated with the wax, the molds are allowed to stand for approximately 15 minutes or until the wax dries to a hazy appearance. Excess dried wax is removed from the mold surfaces with a non-abrasive buffing cloth. Thereafter, the mold release wax is allowed to harden on the mold surfaces for a period of 45 minutes to about 1 hour. If desired, the before-mentioned waxing procedure can be repeated.

Once the mold surfaces of the first and second portions 82, 84 of the body mold 80 have been thoroughly waxed with the mold release wax the first and second portions 82, 84 of the base mold 80 are aligned and secured together by the mold frame 86 such that the passageway 88 is formed and extends therethrough. The seams 89 formed by the junction of the first and second portions 82, 84 of the body mold 80 are desirably filled with molding clay so that a slight depression of approximately 2 mils is produced. The use of the molding clay insures that no leakage of cultured marble composition penetrates the seams of the body mold 80.

The body mold 80 is then positioned such that the body mold 80 is in a substantially horizontal position as shown in FIG. 3. A viscous polyester resin is then applied to the lower portion of the mold surfaces of the first and second portions 82, 84; and the viscous polyester resin is permitted to cure and provide the coated portion of the body mold 80 with a resilient, flexible surface. Once the viscous polyester resin has cured, the body mold 80 is rotated 180 degrees so that the remaining mold surfaces of the first and second portions 82, 84 of the body mold 80 can be coated with the viscous polyester resin so that the entire body mold 80 is provided with a resilient, flexible surface.

It should be noted that the primary ingredients and reactants (i.e. the unsaturated polyester casting resin and the viscous polyester resin) employed in the manufacture of the cultured marble casket 10 share a common chemical base and preferably employ the same catalyst to effect the cross-linking so that positive chemical bonding can occur between successive substrates and the cultured marble composition constituting the exterior surface of the casket 10. For example, the viscous polyester resin applied to the first and second portions 82, 84 of the body mold 80 to provide same with the desired resilient flexible surface often contain clays, talcs, sulfates and carbonates, which provide opacity and function to reduce shrinkage. Generally, the primary constituent of such a viscous polyester resin is styrene monomer.

Viscous polyester resins employed in the surface preparation of molds are well known in the art. Typical of such resins is a commercially available product marketed by H & K Resource Corporation of Hickory, N.C., under the brand name "Gel-Coat".

Any suitable means can be employed for applying the viscous polyester resin to the mold surfaces of the body mold 80 provided the resin is substantially uniformly applied to such mold surfaces. For example, desirable results have been obtained where an airless, externally catalyzed spray gun system has been employed to apply the viscous polyester resin to the mold surfaces so that the entire mold surface is evenly coated to a thickness of from about 0.15 to about 0.25 inches with the viscous polyester resin.

When the viscous polyester resin applied to the mold surfaces has thoroughly dried, the cultured marble composition (which is in the form of a paste) is applied to the dried or cured polyester resin coated surfaces of the body mold 80 so as to substantially cover same. When applying the cultured marble composition, the body mold 80 is maintained in a substantially horizontal position and the cultured marble composition is applied to the lowermost disposed portion of the body mold 80, such as the first portion 82, so that the cultured marble composition covers the mold surfaces of the first portion 82. After the mold surface of the first portion 82 has been covered with the cultured marble composition, and the cultured marble composition permitted to set up so that the it does not flow, the body mold 80 is rotated 180 degrees and the cultured marble composition applied to the second portion 84 of the body mold 70 so as to substantially cover the mold surfaces of the second portion 84. Pneumatic vibrators are then attached to the mold frame 86 of the body mold 80 so that entrapped air in the cultured marble composition can be removed as the cultured marble composition cures.

To form the base or floor member 42 for the body portion 12, the body mold 80 is rotated so that the passageway 88 is substantially vertically disposed. The body mold 80 is then positioned over a floor mold 90 (illustrated in phantom lines in FIG. 4). The floor mold 90 supportingly engages the lower edges of the body mold 80 such that the floor mold 90 extends across the lowermost portion of the passageway 88 in the body mold 80.

To reinforce stress points in the body portion 12 of the casket 10, as well as the interconnection of the base 42 of the casket 10 to the body portion 12, composite reinforcement laminates (i.e. strips of fiberglass) are positioned along such stress points and at the seams or joints formed between the body portion 12 and the base 42. Illustrative of such reinforcement strips are strips of fiberglass shown by phantom lines in FIG. 5 and designated generally by the numeral 92.

The laminate (i.e. fiberglass strips) employed to reinforce the stress points of the body portion 12 is desirably composed of two layers of 1.5 ounce fiberglass mat (providing multiple-directional strength) and one layer of 10 ounce fiberglass cloth (providing bi-directional strength), each of which are saturated with a polyester resin catalyzed with methylethyl ketone peroxide. Entrapped air and excess resin are removed from the laminate with a squeegee; and the resin is then allowed to gel.

To complete the fabrication of the interior portion of the body member 12 and the base 42 thereof, a fiberglass-containing resin is applied to the interior exposed areas of the body member 12 and the base 42 with a chopper-gun, a spraying device which dispenses chop strands of fiberglass, resin and catalyst simultaneously. Entrapped air and excess resin are removed from the interior walls of the body portion 12 and the base 42, while at the same time exercising care to insure that the fiberglass-containing resin is pressed tightly against the interior surfaces of the cured cultured marble composition and the floor mold 90. Strands of fiberglass that may protrude from the resin are gently patted down to insure a substantially smooth surface. The fiberglass-containing resin is then allowed to gel.

Once the interior portion of the body member 12 has been coated with the fiberglass-containing resin, the tubular reinforcement members 44–50 are positioned on the base 42 and an effective amount of fiberglass-containing resin is applied to cover the tubular reinforcement members 44–50 and to secure same to the base 42. Thereafter, the reinforcement members, such as reinforcement members 36–40, employed to reinforce the body member 12 at the location of the attachment of the handle assemblies, are positioned at the desired locations within the body member 12 and secured thereto with the fiberglass-containing resin. The fiberglass-containing resin is allowed to cure for a period of time effective to insure that it is completely hardened. The time required to permit the fiberglass-containing resin to cure can vary widely but will generally be about 2 hours.

After the fiberglass-containing resin applied to the interior surfaces of body member 12 has cured, the first and second portions 82, 84 of the body mold 80 are separated, and the body member 12 is pulled from the body mold 80. Holes for attaching portions of the lock assemblies 26 and the handle assemblies 18, 20 and 22 are drilled, and the adjustable bed member 28 is secured within the cavity 30 formed in the body member 12 of the casket 10. Thus, with the exception of the securing of the decorative fabric material 24 to the interior portion of the body member 12, the body member 12 of the cultured marble casket 10 is complete.

Fabrication of Closure Assembly

Referring now to FIGS. 6–12, the method and molds employed in the fabrication of the closure assembly 14 of the cultured marble casket 10 will be described.

Figure 6:
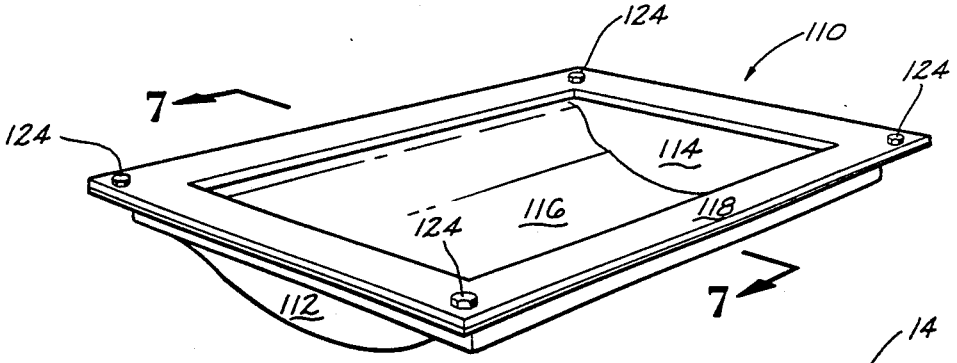
FIG. 6 is a perspective view of a closure mold for forming the closure assembly of the casket.
Figure 7:
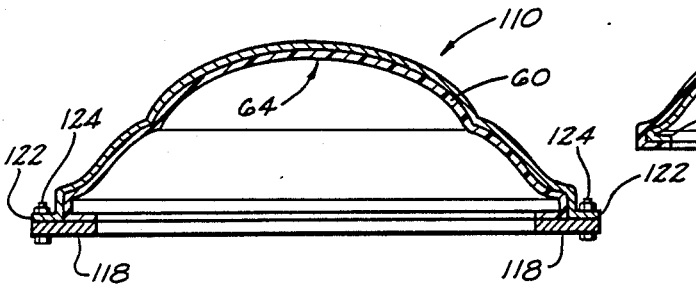
FIG. 7 is a cross-sectional view of the closure mold of FIG. 6 taken along the lines of 7—7 and illustrating the placement of a cultured marble composition forming the exterior surface of the closure assembly disposed within the mold.

Referring to FIGS. 6 and 7, a closure mold 110 employed in the fabrication of the closure assembly 14 of the cultured marbled casket 10 is illustrated. The closure assembly 14 can comprise of a single closure member or of a plurality of closure members, such as closure members 64 and 66. The closure members 64, 66 are substantially identical in construction. Thus, only the mold employed for the fabrication of the closure member 64 will be described, as well as the method for fabricating such closure member.

The closure mold 110 comprises end members 112, 114, a body member 116, and a lip mold 118. The end members 112, 114 and the body member 116 are provided with a configuration so that the mold surfaces formed thereby correspond to the configuration of the exterior surfaces of the closure member 64. Any suitable means can be employed for securing the end members 112, 114 and the body member 116 together, such as bolts (not shown), provided that such means for connecting the members of the closure mold 110 do not extend into or penetrate the interior mold surfaces defined by the closure mold 110.

The lip mold 118, which is employed in the fabrication of a turned under inside lip 120 of the closure member 64, is secured to a flange portion 122 of the closure mold 110 by a plurality of bolts 124. Thus, in an assembled position, the closure mold 110 provides a configuration corresponding to the configuration of the closure member 64, and permits one to readily cast the closure member 64 of the cultured marble composition. As previously stated, the cultured marble composition employed in the fabrication of the closure member 64 is substantially identical to the cultured marble composition employed in the fabrication of the body portion 12 of the cultured marble casket 10.

As has hereinbefore been noted, the quality of the closure member 64 of the cultured marble casket 10 is largely determined by the condition of the mold surfaces of the closure mold 110. That is, any imperfections in the mold surfaces of the closure mold 110 will be repeated in the exterior surface of the closure member 64 so it is very important that the mold surfaces of the closure mold 110 be free of foreign matter, such as glass fibers, gel overspray, hair, dust and the like.

In preparing the closure mold 110 for the fabrication of the closure member 64, all foreign matter is removed from the mold surface such as by applying a positive pressure to the mold surfaces from an air nozzle. After foreign matter has been removed from the mold surfaces, the mold surfaces of the end members 112, 114, the body member 116 and the lip mold 118 are waxed to insure good release of the finished closure member 64 from the mold surfaces of the closure mold 110. The mold release wax is preferably applied with a soft sponge moved in a circular motion, taking care to overlap each adjacent area. Once the entire interior or mold surfaces of the end members 112, 114, the body portion 116 and the lip mold 118 have been thoroughly coated with the wax, the components of the mold are allowed to stand for approximately 15 minutes or until the wax dries to a hazy appearance. Excess dried wax is removed from the mold surfaces with a non-abrasive buffing cloth. Thereafter, the mold release wax is allowed to harden for approximately 45 minutes to about 1 hour. If desired, the before-mentioned waxing procedure can be repeated.

Once the various components constituting the closure mold 110 have been thoroughly waxed with mold release wax, a viscous polyester resin is applied to the mold surfaces of each of the components and the resin is allowed to cure to a gelled state. The time required for the resin to achieve the gelled state can vary widely depending upon the ambient temperature and the relative humidity. Generally, however, the resin attains the desired gelled state within a period of from about 20 to about 30 minutes.

After the resin has obtained the gelled state, the end members 112, 114, the body member 116, and the lip mold 118 are secured together to form the closure mold 110. All inside corners and seams formed by the junction of the members constituting the closure mold 110 are filled with modeling clay to insure a substantially continuous molding surface within the closure mold 110. The viscous polyester resin is gain applied to the mold surface and permitted to cure to a semi-tack-free state so that the coated mold surfaces of the closure mold 110 are provided with a resilient, flexible surface.

Any suitable means can be utilized in the application of the viscous polyester resin to the mold surface of the closure mold 110. However, desirable results have been obtained wherein such resin composition is applied using an airless, externally catalyzed spray gun system wherein the spray gun nozzle is moved in overlapping passes at a distance of approximately 18 inches from the mold surface. The amount of the viscous polyester resin applied to the mold surfaces of the closure mold 110 can vary widely, but will generally be an amount effective to provide the mold surfaces with a coating of the viscous polyester resin of from about 0.15 to about 0.25 inches with the viscous polyester resin.

When the viscous polyester resin applied to the mold surfaces of the closure mold 110 has thoroughly dried, the cultured marble composition (which is in the form of a paste) is applied to the dried or cured polyester resin coated surfaces of the closure mold 110 so as to substantially cover same. In order to provide a substantially uniform covering of the mold surfaces of the closure mold 110, while at the same time insuring the covering of the mold surface defined by the lip mold 118, the cultured marble composition is applied to the interior surface of the closure mold, including the lip mold 118 by a series of steps and procedures. Thus, the steps and procedures for coating the interior surface of the closure mold 110 with the cultured marble composition will now be described with reference to FIGS. 9–12.

Figure 9:
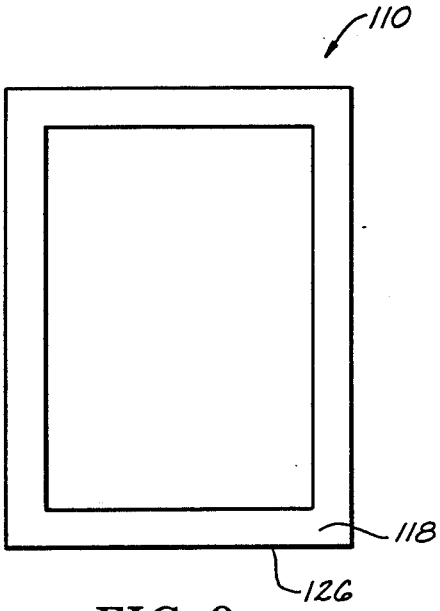
FIG. 9 is a pictorial representation of the closure mold of FIG. 6 disposed in a substantially vertical position so that a first longitudinal edge is disposed as the lowermost portion of the closure mold.
Figure 10:
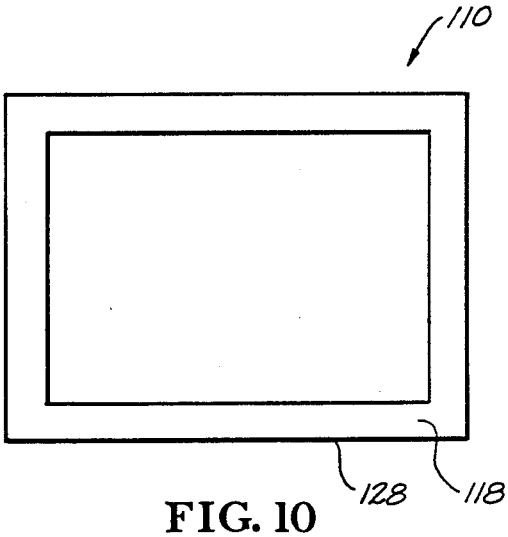
FIG. 10 is a pictorial representation of the closure mold of FIG. 6 wherein the closure mold has been rotated 90 degrees such that a second longitudinal edge is disposed as the lowermost portion of the closure mold.

As shown in FIG. 9, the closure mold 110 is rotated to a substantially vertical position so that a first longitudinal edge 126 thereof is disposed as the lowermost portion of the closure mold 110. While the closure mold 110 is maintained in this vertical position, a portion of the cultured marble composition is applied to the lower portion of the interior surface of the closure mold 110 and the cultured marble composition is allowed to gravitationally descend and cover the adjacent portion of the lip mold 118. After the cultured marble composition has descended to substantially cover the lip portion defined by the lip mold 118, the closure mold 110 is rotated to the position indicated in FIG. 10 wherein a second longitudinal edge 128 thereof is disposed as the lowermost portion of the closure mold 110. A second portion of the cultured marble composition is then applied to the lower portion of the interior surface of the closure mold 110 such that the marble composition gravitationally descends and covers the lip portion defined by the lip mold 118. Thereafter, the rotation of the closure mold 110 is continued, as is the application of a portion of the cultured marble composition, until each of the adjacent lip portions defined by the lip mold 118 have been covered with the cultured marble composition.

Figure 11:
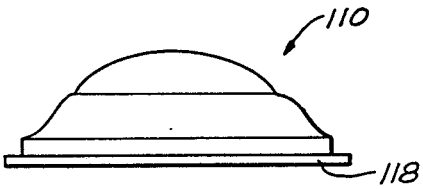
FIG. 11 is an elevational view of one end of the closure mold of FIG. 6 wherein the closure mold has been rotated such that the closure mold is substantially horizontally disposed in a downwardly facing position.

The closure mold 110 is then rotated 90 degrees such that the closure mold 110 is substantially horizontally disposed in a downwardly facing position as illustrated in FIG. 11. By positioning the closure mold 110 in the horizontal position as depicted, a uniform marble surface is formed on the lip portion of the closure mold 110 defined by the lip mold 118. While the closure mold 110 is maintained in the horizontally disposed downwardly facing position, pneumatic vibrators (not shown) are attached to the closure mold 110 to remove entrapped air from the cultured marble composition.

Figure 12:
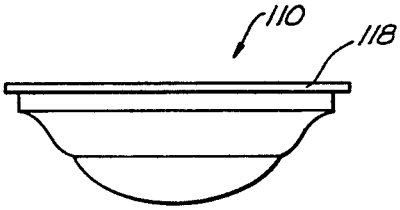
FIG. 12 is an elevational view of one end of the closure mold of FIG. 6 wherein the closure mold has been rotated 180 degrees relative to the position of the closed mold illustrated in FIG. 11 so that the closure mold is substantially horizontally disposed in an upwardly facing position.

After the cultured marble composition has cured, the pneumatic vibrators are deactivated and the closure mold 110 is rotated 180 degrees so as to be disposed in a substantially, upwardly facing position as illustrated in FIG. 12. A portion of the marble composition is deposited on the highest part of the mold surfaces near each of the sides of the closure mold 110 and the composition is allowed to gravitationally descend into the lower or central area of the closure mold 110. When the molding surfaces of the closure mold 110 have been completely covered, excess marble composition is removed from the lowermost areas. The pneumatic vibrators are again activated so that entrapped air in the cultured marble composition is caused to rise away from the mold surface and through the cultured marble composition. The closure mold 110 is maintained in the position illustrated in FIG. 12 during both the removal of the entrapped air from the cultured marble composition and while permitting the cultured marble composition to cure.

Composite reinforcement laminate, (i.e. strips of fiberglass saturated with a polyester resin catalyzed with methylethyl ketone peroxide can be secured around the lip portion 120 of the closure member 64 to provide strength thereto and to enhance the stability of the lip portion 120 for anchoring portions of the lock or securing assemblies 26 supported by the closure member 64. Entrapped air and excess resin can be removed from the laminate with a squeegee; and the resin is then allowed to gel.

To complete the fabrication of the interior portion of the closure member 64, a fiberglass-containing resin is applied to the interior exposed surface areas of the closure member 64 with a chopper-gun, a spray device which dispenses chopped strands of fiberglass resin and catalyst simultaneously. Entrapped air and excess resin are removed from the interior walls of the closure member 64, while at the same time exercising care to insure that the fiberglass-containing resin is pressed tightly against the interior surfaces of the cured cultured marble composition. Strands of fiberglass that may protrude from the resin are gently patted down to insure a substantially smooth surface. The fiberglass-containing resin is then allowed to gel.

After the fiberglass-containing resin has cured, the lip mold 118 is removed, and thereafter the end members 112, 114 and body member 116 of the closure mold 110 are separated and the closure member 64 is pulled from the mold. Holes for attaching portions of the locking assemblies 26 and for pivotally connecting the closure member 64 to the body portion 12 of the cultured marble casket 10 are drilled and the lock assemblies and hinge means connected so that the closure member 64 can be pivotally connected to the body portion 12. Thus, with the exception of securing the decorative fabric material 24 to the interior portion of the closure member 64, the closure member 64 of the cultured marble casket 10 is complete.

From the above, it becomes apparent that the body portion 12 and the closure assembly 14 of the cultured marble casket 10 is provided with an exterior surface fabricated of a cultured marble composition and an interior portion fabricated of a fiberglass-containing resinous material. In the fabrication of such components slight defects may be detected once the marble composition has cured in that thin spots in the marble composition may be detected which would tend to discolor the exterior surface of the marble composition. In such instance, it has been determined that such defects can be readily cured by applying a coating of the viscous polyester resin employed to form the resilient flexible surface for each of the respective molds to the interior surface of the cultured marble composition. When same is required, an effective amount of a pigment is admixed with the viscous polyester resin to provide same with a base color substantially corresponding to the base color of the cultured marble composition. Once the pigment containing viscous polyester resin has been applied to the interior surface of the cured marble composition and allowed to dry, one can then proceed with the application of the fiberglass-containing resin forming the interior portion of both the body portion 12 and the closure assembly 14 as heretofore described.

The cultured marble casket 10 of the present invention, as well as the method for producing same, enables one to readily produce a durable, light weight casket having aesthetic qualities heretofore unavailable with known procedures. Further, because of the interconnection of the various components of the cultured marble casket 10 an improved casket is provided which is durable, substantially resistent to deterioration, and which can be economically manufactured without requirements of highly skilled personnel or specialized expensive equipment.

It is clear that the present invention is well adapted to carry out the objects and attain the ends and advantages mentioned herein as well as those inherent in the invention. While presently preferred embodiments of the invention have been described for purposes of this disclosure, numerous changes may be made which will readily suggest themselves to those skilled in the art and which are accomplished within the spirit of the invention disclosed and as defined in the appended claims.

What is claimed is:

1. A cultured marble casket comprising:

a base member;

a body member having an exterior portion, the body member and base member cooperating to define a cavity therebetween, the exterior portion of the body member fabricated of a cultured marble composition comprising from about 40 to about 60 parts by weight of a polyester casting resin, from about 80 to about 120 parts by weight of a particulate material, a catalytic amount of a catalyst capable of cross-linking the polyester casting resin, and an effective minor amount of a pigment capable of providing the cultured marble composition with the desired color and texture appearance;

closure means pivotally connected to the body member for selectively sealing the cavity of the body member, and for permitting access thereto; and securing means for securing the closure means to the body member when the closure means is in the closed position.

2. The cultured marble casket of claim 1 wherein the body member is further characterized as having an interior portion defining the cavity, the interior portion having a fiberglass-containing resinous material adhered to an interior surface of the cultured marble composition.

3. The cultured marble casket of claim 2 further comprising an adjustable bed member disposed within a lower portion of the cavity and supported in a selected position a predetermined distance from the base member.

4. The cultured marble casket of claim 3 wherein the closure means is characterized as having an exterior surface and an interior surface, the exterior surface fabricated of a cultured marble composition comprising from about 40 to about 60 parts by weight of a polyester casting resin, from about 80 to about 120 parts by weight of a particulate material, a catalytic amount of a catalyst capable of cross-linking the polyester casting resin, and an effective minor amount of a pigment capable of providing the cultured marble composition with the desired color and texture appearance, the interior surface of the closure means having a fiberglass-containing resinous material adhered to an interior surface of the cultured marble composition constituting the exterior surface of the closure means.

5. The cultured marble casket of claim 4 wherein the catalytic amount of catalyst employed in the cultured marble compositions of the body member and the closure means is from about 0.06 to about 0.2 parts by weight based on the total weight of the composition.

6. The cultured marble casket of claim 5 wherein the effective minor amount of pigment employed in the cultured marble compositions of the body member and the closure means is from about 0.03 to about 0.13 parts by weight based on the total weight of the composition.

7. The cultured marble casket of claim 6 further comprising a coating of a viscous polyester resin having a color corresponding to the base color of the cultured marble composition, the viscous polyester resin consisting essentially of styrene monomer.

8. The cultured marble casket of claim 7 further comprising a decorative fabric material disposed adjacent the fiberglass-containing surfaces of the body member and the closure means.

9. The cultured marble casket of claim 8 wherein the base member comprises a fiberglass-containing resinous material.

10. The cultured marble casket of claim 9 further comprising reinforcing members disposed on the base member for enhancing the strength thereof.

11. The cultured marble casket of claim 10 further comprising handle means secured to the body member for permitting the casket to be hand carried.

12. The cultured marble casket of Claim 2 wherein the base member comprises a fiberglass-containing resinous material.

13. The cultured marble casket of claim 12 further comprising reinforcing members disposed along and secured to the base member for enhancing the strength thereof.

14. The cultured marble casket of claim 13 further comprising means disposed along selected interior portions of the body member for enhancing and reinforcing such portions of the body member.

15. The cultured marble casket of claim 14 further comprising handle means secured to the body member for permitting the casket to be hand carried.

16. The cultured marble casket of claim 15 further comprising a decorative fabric material disposed adjacent the interior fiberglass-containing surfaces of the body member and the closure means.

17. The cultured marble casket of claim 1 wherein the particulate material employed in the formulation of the cultured marble composition is selected from the group consisting of marble dust, aluminum trihydrate, frit, silica sand and mixtures thereof.

18. A method for fabricating a cultured marble casket comprising:

applying an effective amount of a mold-release agent to a body mold to effectively cover an interior surface thereof, the body mold comprising a first portion and a second portion such that when the first and second portions thereof are matingly aligned and secured together a passageway is formed extending therethrough;

applying an effective amount of a viscous polyester resin to substantially cover the interior surface of the body mold, the viscous polyester resin consisting essentially of styrene monomer which, upon curing, provides the body mold with a resilient, flexible surface;

applying a cultured marble composition to the cured polyester resin-coated surface of the body mold to substantially cover same, and thereby provide a body portion for the casket having a cultured marble-appearing finish;

forming a base member for the body member, the base member disposed within a lower portion of the passageway defined by the body member and secured to the body member such that the body member and the base member constitute a unitary member;

applying an effective amount of a mold-release agent to at least one closure mold to substantially cover an interior surface thereof;

applying an effective amount of a viscous polyester resin to the cover mold to substantially cover the interior surface thereof, the viscous polyester resin consisting essentially of styrene monomer which, upon curing, provides a resilient, flexible surface to the interior surfaces of the cover mold;

applying a cultured marble composition to the cured polyester resin-coated surface of the cover mold to substantially cover same, and thereby provide a closure member for the casket having a cultured marble-appearing finish;

removing the body member and the closure member from their respective molds; and connecting the closure member to the body member by a pivotal attachment so that the closure member can be selectively pivoted between a first body opening position and a second body closing position.

19. The method of claim 18 wherein the body mold is disposed in a substantially horizontal first position such that each side of the body mold defining the passageway therethrough is horizontally disposed and wherein the step of applying the viscous polyester resin to the body mold comprises the steps of:

applying the viscous polyester resin to a lower disposed surface of the body mold, including the lower portions of each end thereof;

maintaining the body mold in the first horizontal position for a period of time effective to permit the viscous polyester resin to cure;

rotating the body mold 180 degrees such that the body mold is disposed in a substantially horizontal second position;

applying the viscous polyester resin to the lower disposed surfaces of the body mold, including the lower portions of each end thereof; and maintaining the body mold in the second horizontal position for a period of time effective to permit the viscous polyester resin to cure.

20. The method of claim 19 wherein the closure mold further comprises a lip mold, the lip mold having an inwardly disposed surface which is coated with a viscous polyester resin, and wherein the step of applying the cultured marble composition to the interior surface of the closure mold and the lip mold comprises the steps of:

disposing the closure mold in a substantially vertical position so that a first longitudinal edge is disposed as the lowermost portion of the closure mold;

applying a portion of the cultured marble composition to a lower portion of the interior surface of the closure mold such that the cultured marble composition gravitationally descends and covers the adjacent inwardly disposed surface of the lip mold;

rotating the closure mold such that a second longitudinal edge is disposed as the lowermost portion of the closure mold;

applying a portion of the cultured marble composition to the lower portion of the interior surface of the closure mold such that the cultured marble composition gravitationally descends and covers the adjacent inwardly disposed surface of the lip mold;

rotating the closure mold such that a third longitudinal edge is disposed as the lowermost portion of the closure mold;

applying a portion of the cultured marble composition to the lower portion of the interior surface of the closure mold such that the cultured marble composition gravitationally descends and covers the adjacent inwardly disposed surface of the lip mold;

rotating the closure mold such that a fourth longitudinal edge is disposed as the lowermost portion of the closure mold;

applying a portion of the cultured marble composition to the lower portion of the interior surface of the closure mold such that the cultured marble composition gravitationally descends and covers the adjacent inwardly disposed surface of the lip mold;

rotating the closure mold 90 degrees such that the closure mold is substantially horizontally disposed in a substantially downwardly facing position and thereby enhancing a uniform marble surface on the lip portion of the closure mold;

maintaining the closure mold in the horizontally disposed downwardly facing position for a period of time effective to permit the cultured marble composition to set up;

rotating the closure mold 180 degrees such that the closure mold is substantially horizontally disposed in a substantially upwardly facing position;

applying an effective amount of the cultured marble composition to the interior surface of the closure mold to coat the remaining surface thereof; and maintaining the closure mold in the substantially horizontally disposed upwardly facing position for a period of time effective to permit the cultured marble composition to set up.

21. The method of claim 20 further comprising: positioning a base mold substantially adjacent one end of the passageway formed through the body member; and applying a fiberglass-containing resinous material to the mold such that the resinous material adheres to the adjacently disposed interior surface of the body member and provides a casket having a base member and body member of unitary configuration.

22. The method of claim 21 wherein the first and second portions of the body mold are each provided with ledge portions extending around the first and second portions so as to be disposed along an outwardly extending portion of each of said first and second portions, and wherein the method further comprises:

disposing strips of fiberglass material along the ledge portions of the first and second portions of the body mold prior to coating the interior surface with the fiberglass-containing resinous material.

23. The method of claim 22 further comprising:

vibrating the closure mold when same is maintained in the horizontally disposed downwardly facing position and the horizontally disposed upwardly facing position for a period of time effective to remove entrained air from the cultured marble composition.

24. The method of claim 23 further comprising:

applying an effective amount of a second viscous polyester resin to the interior surface of the cultured marble composition forming the body member and closure member of the casket prior to application of the fiberglass-containing resinous material, the second viscous polyester resin having a color substantially corresponding to the base color of the cultured marble composition.

25. The method of claim 24 further comprising:

positioning a plurality of reinforcing members along the interior surface of the base member and securing the reinforcing members thereto by applying an effective amount of the fiberglass-containing resinous material.

26. The method of claim 25 further comprising:

connecting a plurality of handle members to the body member of the casket; and connecting a plurality of locking members to the closure member of the casket, the locking members adapted to engage the body member and secure the closure member to the body member.

27. The method of claim 26 further comprising:

positioning an adjustable bed member in the lower portion of the body member and securing the adjustable bed member thereto.

28. The method of claim 27 further comprising covering the interior portion of the body member and the closure member with a decorative fabric.

29. The method of claim 28 further comprising covering the adjustable bed member with a decorative

30. The method of claim 22 further comprising the steps of applying molding clay to each joint formed in the body mold and the closure mold.

31. The method of claim 30 further comprising:

removing the body member and the closure member from their respective molds, sanding the exterior surfaces thereof to remove any irregularities in the exterior surfaces and buffing the exterior surfaces to provide the casket with the desired surface gloss.

32. A method for fabricating a cultured marble casket comprising:

applying an effective amount of a viscous polyester resin to substantially cover the interior surface of the body mold, the viscous polyester resin consisting essentially of styrene monomer which, upon curing, provides the body mold with a resilient, flexible surface;

applying a cultured marble composition to a resin-coated surface of a body mold to substantially cover same, and thereby provide a body portion for the casket having a cultured marble-appearing finish, the body mold comprising a first portion and a second portion such that when the first and second portions thereof are matingly aligned and secured together a passageway is formed extending therethrough;

forming a base member for the body member, the base member disposed within a lower portion of the passageway defined by the body member and secured to the body member such that the body member and the base member constitute a unitary member;

applying a cultured marble composition to a resin-coated surface of the cover mold to substantially cover same;

removing the body member and the closure member from their respective molds; and connecting the closure member to the body member by a pivotal attachment so that the closure member can be selectively pivoted between a first body opening position and a second body closing position.

33. The method of claim 32 wherein the closure mold further comprises a lip mold, the lip mold having an inwardly disposed surface which is coated with a viscous polyester resin, and wherein the step of applying the cultured marble composition to the interior surface of the closure mold and the lip mold comprises the steps of:

disposing the closure mold in a substantially vertical position so that a first longitudinal edge is disposed as the lowermost portion of the closure mold;

applying a portion of the cultured marble composition to a lower portion of the interior surface of the closure mold such that the cultured marble composition gravitationally descends and covers the adjacent inwardly disposed surface of the lip mold;

rotating the closure mold such that a second longitudinal edge is disposed as the lowermost portion of the closure mold;

applying a portion of the cultured marble composition to the lower portion of the interior surface of the closure mold such that the cultured marble composition gravitationally descends and covers the adjacent inwardly disposed surface of the lip mold;

rotating the closure mold such that a third longitudinal edge is disposed as the lowermost portion of the closure mold;

applying a portion of the cultured marble composition to the lower portion of the interior surface of the closure mold such that the cultured marble composition gravitationally descends and covers the adjacent inwardly disposed surface of the lip mold;

rotating the closure mold such that a fourth longitudinal edge is disposed as the lowermost portion of the closure mold;

applying a portion of the cultured marble composition to the lower portion of the interior surface of the closure mold such that the cultured marble composition gravitationally descends and covers the adjacent inwardly disposed surface of the lip mold;

rotating the closure mold 90 degrees such that the closure mold is substantially horizontally disposed in a substantially downwardly facing position and thereby enhancing a uniform marble surface on the lip portion of the closure mold;

maintaining the closure mold in the horizontally disposed downwardly facing position for a period of time effective to permit the cultured marble composition to set up;

rotating the closure mold 180 degrees such that the closure mold is substantially horizontally disposed in a substantially upwardly facing position;

applying an effective amount of the cultured marble composition to the interior surface of the closure mold to coat the remaining surface thereof; and maintaining the closure mold in the substantially horizontally disposed upwardly facing position for a period of time effective to permit the cultured marble composition to set up.

34. The method of claim 33 further comprising:

positioning a base mold substantially adjacent one end of the passageway formed through the body member; and applying a fiberglass-containing resinous material to the mold such that the resinous material adheres to the adjacently disposed interior surface of the body member and provides a casket having a base member and body member of unitary configuration.

35. The method of claim 34 wherein the first and second portions of the body mold are each provided with ledge portions extending around the first and second portions so as to be disposed along an outwardly extending portion of each of said first and second portions, and wherein the method further comprises:

disposing strips of fiberglass material along the ledge portions of the first and second portions of the body mold prior to coating the interior surface with the fiberglass-containing resinous material.

36. The method of claim 35 further comprising:

applying an effective amount of a second viscous polyester resin to the interior surface of the cultured marble composition forming the body member and closure member of the casket prior to application of the fiberglass-containing resinous material, the second viscous polyester resin having a color substantially corresponding to the base color of the cultured marble composition.

37. The method of claim 36 further comprising: vibrating the closure mold when same is maintained in the horizontally disposed downwardly facing position and the horizontally disposed upwardly facing position for a period of time effective to remove entrained air from the cultured marble composition.

38. The method of claim 36 further comprising:

connecting a plurality of handle members to the body member of the casket; and connecting a plurality of locking members to the closure member of the casket, the locking members adapted to engage the body member and secure the closure member to the body member to seal same when the closure member is in the second body closing position.

39. The method of claim 38 further comprising:

positioning an adjustable bed member in the lower portion of the body member and securing the adjustable bed member thereto.

40. The method of claim 39 further comprising covering the interior portion of the body member and the closure member and the bed member with a decorative fabric.

41. The method of claim 35 further comprising the steps of applying molding clay to each joint formed in the body mold and the closure mold.

42. The method of claim 34 further comprising:

sanding the exterior surfaces of the body member and the closure members when same have been removed from their respective molds to remove any irregularities in the exterior surfaces and buffing the exterior surfaces to provide the casket with the desired surface gloss.

43. The method of claim 37 wherein the cultured marble composition comprises from about 40 to about 60 parts by weight of a polyester casting resin, from about 80 to about 120 parts by weight of a particulate material, a catalytic amount of a catalyst capable of cross-linking the polyester casting resin, and an effective minor amount of a pigment capable of providing the cultured marble composition with the desired color and texture appearance.

44. The method of claim 43 wherein the particulate material employed in the formulation of the cultured marble composition is selected from the group consisting of marble dust, aluminum trihydrate, frit, silica sand and mixtures thereof.

* * * * *

UNITED STATES PATENT AND TRADEMARK OFFICE

CERTIFICATE OF CORRECTION

PATENT NO. : 4,890,366

DATED : January 2, 1990

INVENTOR(S) : Kenneth L. Schaapveld

It is certified that error appears in the above—identified patent and that said Letters Patent is hereby corrected as shown below:

Column 9, line 31, after "dispenses", change " chop" to --chopped--;

Column 11, line 23, change "gain" to --again--;

Column 12, line 44, change "peroxide can" to --peroxide can)--; and

Column 17 (claim 29), line 68, after "decorative" insert --fabric--.

Signed and Sealed this

Nineteenth Day of February, 1991

*Attest:*

HARRY F. MANBECK, JR.

*Attesting Officer*

*Commissioner of Patents and Trademarks*